US008856994B2

(12) United States Patent
Powers

(10) Patent No.: US 8,856,994 B2
(45) Date of Patent: Oct. 14, 2014

(54) PUNCH DOWN TOOL WITH REVERSIBLE PUNCH DOWN BLADE ASSEMBLY

(71) Applicant: Klein Tools, Inc., Lincolnshire, IL (US)

(72) Inventor: Konrad Powers, Carol Stream, IL (US)

(73) Assignee: Klein Tools, Inc., Lincolnshire, IL (US)

( * ) Notice: Subject to any disclaimer, the term of this patent is extended or adjusted under 35 U.S.C. 154(b) by 246 days.

(21) Appl. No.: 13/667,956

(22) Filed: Nov. 2, 2012

(65) Prior Publication Data

US 2014/0123397 A1 May 8, 2014

(51) Int. Cl.
*B25F 1/02* (2006.01)
*H01R 43/00* (2006.01)

(52) U.S. Cl.
USPC ..... 7/108; 7/107; 81/439

(58) Field of Classification Search
CPC ... B25B 23/0035; B25B 23/0042; B25F 1/02; H01R 43/015
USPC ..... 81/437–439; 7/107, 108; 29/566.4, 29/750–752
See application file for complete search history.

(56) References Cited

U.S. PATENT DOCUMENTS

| | | | | | |
|---|---|---|---|---|---|
| 3,708,852 | A | | 1/1973 | Mason | |
| 4,161,061 | A | * | 7/1979 | Mason et al. | 29/566.4 |
| 4,241,496 | A | * | 12/1980 | Gregson | 29/751 |
| 5,604,948 | A | | 2/1997 | McMahon et al. | |
| 5,819,612 | A | * | 10/1998 | Anderson | 81/490 |
| 5,904,080 | A | | 5/1999 | Anderson | |
| 6,070,301 | A | | 6/2000 | Fallandy | |
| 6,250,185 | B1 | * | 6/2001 | Tsung | 81/439 |
| 6,286,400 | B1 | * | 9/2001 | Anderson et al. | 81/439 |
| 6,351,865 | B1 | * | 3/2002 | De Donato | 7/107 |
| 6,374,711 | B2 | * | 4/2002 | Anderson et al. | 81/490 |
| 6,425,307 | B1 | * | 7/2002 | Chen | 81/439 |
| 6,494,121 | B1 | * | 12/2002 | Hu | 81/439 |
| 6,615,480 | B1 | * | 9/2003 | Murphy | 29/566.4 |
| 7,096,564 | B2 | * | 8/2006 | Sullivan | 29/566.4 |
| 7,266,878 | B1 | * | 9/2007 | Sullivan | 29/566.4 |
| 8,220,135 | B2 | * | 7/2012 | Vogel et al. | 29/566.4 |
| 8,443,508 | B2 | | 5/2013 | Vogel et al. | |
| 2005/0092141 | A1 | | 5/2005 | Cho | |
| 2006/0107801 | A1 | | 5/2006 | Hsien | |
| 2007/0044596 | A1 | | 3/2007 | Chen | |
| 2010/0269263 | A1 | * | 10/2010 | Burch et al. | 7/108 |
| 2010/0306990 | A1 | | 12/2010 | Vogel et al. | |

OTHER PUBLICATIONS

Klein Punch Down Tool, picture, 1 page, Oct. 2012.

* cited by examiner

*Primary Examiner* — David B Thomas
(74) *Attorney, Agent, or Firm* — McDonnell Boehnen Hulbert & Berghoff LLP

(57) ABSTRACT

A hand tool with a handle with an inner cavity, a tool bit holder removably secured within the inner cavity and having a first end adapted for receiving a first reversible tool bit and a second end adapted for receiving a second reversible tool bit, wherein a first reversible tool bit may be removably secured within an inner cavity positioned within the first end of the tool bit holder using a circular spring clip extending around an outer surface of the first end of the tool bit holder, wherein a second reversible tool bit may be removably secured within an inner cavity positioned within the second end of the tool bit holder, wherein the first reversible tool bit has a first punch down blade and a second punch down blade, and wherein the outer diameter of the first end of the tool bit holder is 0.532 inches or less.

33 Claims, 7 Drawing Sheets

PUNCH DOWN TOOL WITH REVERSIBLE PUNCH DOWN BLADE ASSEMBLY

BACKGROUND

The present embodiments generally relate to hand tools. More particularly, the present embodiments pertain to a class of tools generally referred to as punch down tools. Punch down tools are hand tools that may be used by telecommunications and network technicians for inserting wire into insulation-displacement connectors on punch down blocks, patch panels, keystone modules, and surface mount boxes.

There a number of types of existing punch down tools. For example, an impact type punch down tool includes a handle, an internal spring mechanism, and a removable slotted blade. To use an impact type punch down tool, a wire may first be positioned into a slotted post, then the slotted blade is pressed down on top of the wire, over the post. An internal spring mechanism in the impact punch down tool resists the pushing until a required pressure is reached, at which time the internal spring is released and the wire is pushed into the slot by the blade, thereby cutting the insulation and securing the wire.

Other punch down tools lack the internal spring mechanism, but may include a reversible blade assembly common to punch down tools. Standardized reversible punch down inserts are designed to work with specific cable and connector types, e.g. 66, 110, etc. Thus, a type 110 blade may be used to punch down Cat5/Cat6 cable to 110 jacks and patch panels, as an example, and a type 66 blade may be used to punch down telephone wire to 66M blocks, as an example. The most common type of reversible slotted blade is a double-ended blade with 66 type and 110 type blades mounted on opposite ends of a common shaft, although both ends could be 110 type ends, or a 66 type ends, or some other combination of known punch down blades.

With a standardized reversible punch down insert, the 66 type end or the 110 type end may extend from the punch down tool and the punch down insert may be twisted to lock the reversible punch down insert into place using a bayonet-style connector. When it is desired to have the other end of the punch down insert extend from the punch down tool, the reversible punch down insert removed, rotated 180 degrees, and re-inserted into the punch down tool where it may again be twisted and locked into place using a bayonet-style connector. Other punch down tools may not include a reversible slotted blade, and may include only a single, fixed blade attached to the handle.

There are a number of drawbacks with currently available punch down tools. For example, existing punch down tools have a narrow scope of usefulness as the punch down tool is typically only used for the limited purpose of the punch down operation. Furthermore, punch down tools have a relatively large size. Nonetheless, even though the punch down tools may be used infrequently and are relatively large, data communication technicians and electricians still may need to carry punch down tools along with all of the other types of tools necessary for their work. It may be a hassle for them to gather all of the separate tools that may be needed. It may also be unwieldy and cumbersome to carry all of the tools at the same time that may be required. In addition, it is also costly for a technician or electrician to purchase and carry all of the various tools that may be required.

Therefore, it would be desirable if existing punch down tools could somehow be combined with other tools that are carried by technicians to reduce the overall number of tools that a technician may be required to carry. As noted above, a standardized reversible punch down insert having a 110 end and a 66 end has a fairly large diameter and includes a retaining ring spring or circular spring clip that is used to removably secure the standardized reversible punch down insert to a shaft in the tool. The shaft that is typically used with the standardized reversible punch down insert is relatively thick and requires a large diameter handle to house the shaft. As a result, the overall shape of a punch down tool typically includes a handle that is very thick to accommodate the standardized reversible punch down insert, circular spring clip, and shaft. Consequently, the overall shape of the punch down tool, including the wide shaft and handle, makes for an unwieldy, oversized, and undesirable screwdriver if it were adapted to also receive reversible screwdriver bits.

It is known to provide a screwdriver having reversible bits. For example, some screwdrivers include a removable hollow shaft adapted for housing a bit holder on either end thereof. Reversible bits that may have a Phillips head on one end and a slotted end on the other end of the reversible bit may be placed within the bit holder in the screwdriver. The screwdrivers may also include bits of varying sizes to provide greater versatility to the screwdriver. Typical screwdrivers adapted for reversible screwdriver bits, however, are generally relatively small in diameter and do not accommodate the relatively larger size standardized reversible punch down insert having a 110 type end and a 66 type end and the accompanying shaft and circular spring clip typically used with the standardized reversible punch down insert.

SUMMARY

In one aspect, a hand tool is provided having a handle with an inner cavity, a tool bit holder removably secured within the inner cavity and having a first end adapted for receiving a first reversible tool bit and a second end adapted for receiving a second reversible tool bit, wherein a first reversible tool bit may be removably secured within an inner cavity positioned within the first end of the tool bit holder using a circular spring clip extending around an outer surface of the first end of the tool bit holder, wherein a second reversible tool bit may be removably secured within an inner cavity positioned within the second end of the tool bit holder, wherein the first reversible tool bit has a first punch down blade on a first end thereof and a second punch down blade on a second end thereof, and wherein the outer diameter of the first end of the tool bit holder is 0.532 inches or less.

In a further aspect, a hand tool is provided having a handle with an inner cavity, a tool bit holder removably secured within the inner cavity of the handle, the tool bit holder having a first end adapted for receiving a first reversible tool bit and a second end adapted for receiving a second reversible tool bit, wherein a first reversible tool bit may be removably secured within an inner cavity positioned within the first end of the tool bit holder using a circular spring clip extending around an outer surface of the first end of the tool bit holder, wherein a second reversible tool bit may be removably secured within an inner cavity positioned within the second end of the tool bit holder, wherein the first reversible tool bit has a first punch down blade on a first end thereof and a second punch down blade on a second end thereof, and wherein the circular spring clip has a thickness in a longitudinal direction that is more than 7 times a thickness of the circular spring clip measured between an inner diameter of the circular spring clip and an outer diameter of the circular spring clip.

In another aspect, a hand tool is provided having a handle with an inner cavity, a tool bit holder removably secured within the inner cavity of the handle, the tool bit holder having a first end adapted for receiving a first reversible tool bit and a second end adapted for receiving a second reversible tool bit, wherein a first reversible tool bit may be removably secured within an inner cavity positioned within the first end of the tool bit holder using a circular spring clip extending around the outer surface of the first end of the tool bit holder, wherein a second reversible tool bit may be removably secured within an inner cavity positioned within the second end of the tool bit holder, wherein the first reversible tool bit has a first punch down blade on a first end thereof and a second punch down blade on a second end thereof, wherein the circular spring clip has a thickness in a longitudinal direction of 0.197 inches or more and a thickness of the circular spring clip measured between an inner diameter of the circular spring clip and an outer diameter of the circular spring clip is between 0.022 and 0.026 inches, and wherein the outer diameter of the circular spring clip does not extend beyond the outer surface of the first end of the tool bit holder.

BRIEF DESCRIPTION OF THE DRAWINGS

Exemplary embodiments of the invention are described herein with reference to the drawings, wherein like parts are designated by like reference numerals, and wherein.

DETAILED DESCRIPTION

Figure 1:
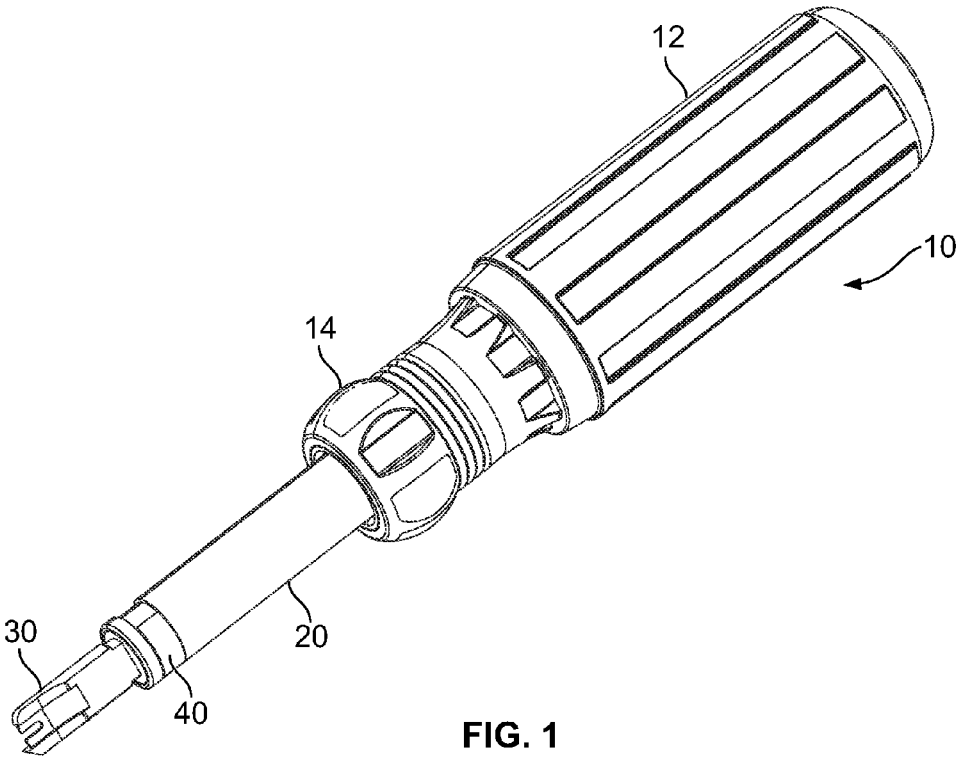
FIG. 1 is a perspective view of hand tool 10 shown with a punch down blade extending therefrom.
Figure 2:
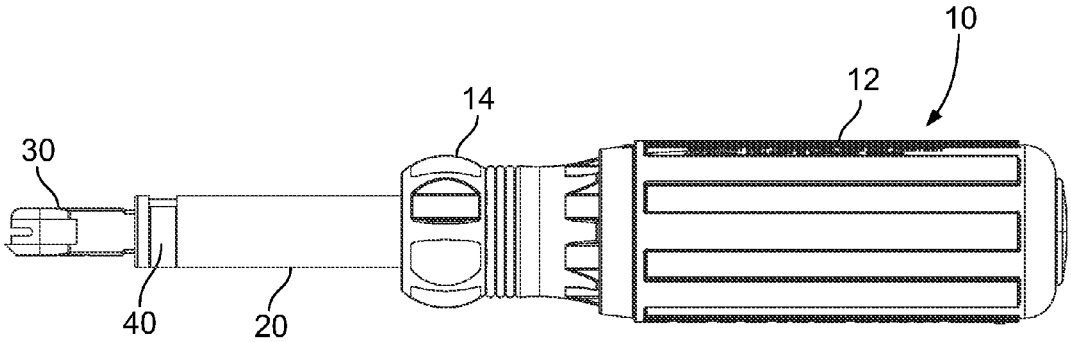
FIG. 2 is a side view of the hand tool 10 shown in FIG. 1.
Figure 3:
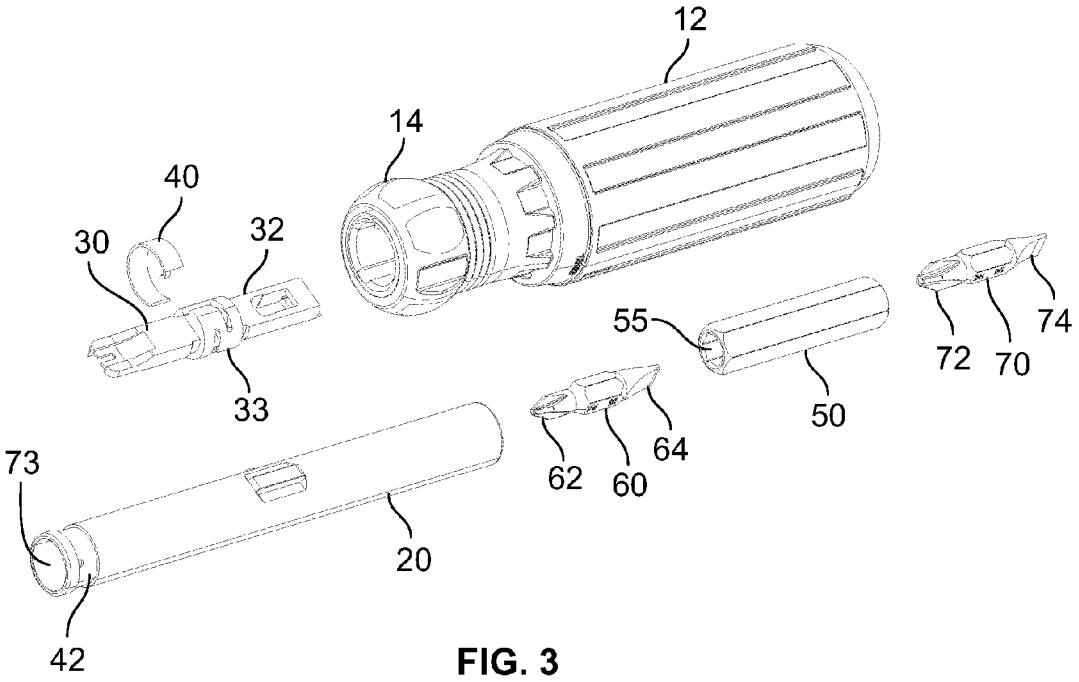
FIG. 3 is a partially exploded perspective view of hand tool 10 shown in FIGS. 1 and 2, including the tool bit holder 20, first reversible tool bit 33, and second reversible tool bit 50.
Figure 4:
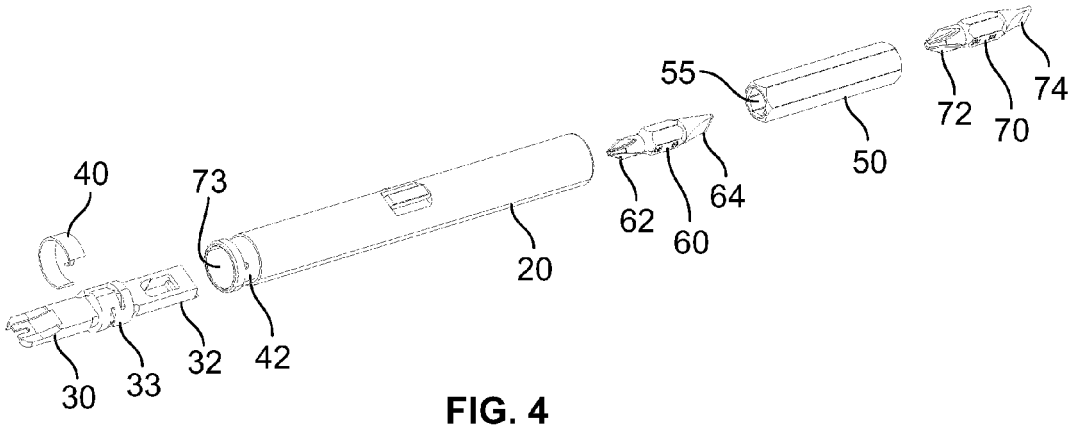
FIG. 4 is an exploded perspective view of the tool bit holder assembly, including tool bit holder 20, first reversible tool bit 33, and second reversible tool bit 50, that is positioned within hand tool 10 in FIGS. 1 and 2.

FIG. 1 is a perspective view of a hand tool 10 having a handle 12 and a tool bit holder 20 removably retained in handle 12. FIG. 2 is a side view of the hand tool 10 shown in FIG. 1. Tool bit holder 20 is shown having punch down blade 30 extending from tool bit holder 20 and removably held in place with circular spring clip 40 positioned within an external groove on tool bit holder 20. FIGS. 3 and 4 are partial perspective, exploded views of the hand tool 10 shown in FIGS. 1 and 2. A standardized reversible punch down insert 33 is shown having a 110 type punch down blade 30 on a first end thereof and a 66 type punch down blade 32 on a second end thereof.

The first end of the tool bit holder 20 is adapted to receive the standardized reversible punch down insert 33 in an inner cavity 73 on the first end of the tool bit holder 20. The standardized reversible punch down insert 33 includes a first punch down blade 30 on a first end thereof and a second punch down blade 32 on a second end thereof. The standardized reversible punch down insert 33 is removably secured within inner cavity 73 on the first end of the first tool bit holder 20 with circular spring clip 40 that is positioned within groove 42 located on the outer diameter of the first end of tool bit holder 20.

The second end of tool bit holder 20 includes an inner cavity (not shown) for receiving a second reversible tool bit 50. Second reversible tool bit 50 includes a bit driver on a first end thereof and a second end thereof. The bit drivers may be hex shaped (as shown) to serve as nut drivers which may vary in size if desired. In addition, the first end of the second reversible bit 50 includes an inner cavity 55 that is adapted to receive a first reversible tool bit 60 having a first end 62 that is a Philips head and a second end 64 that is a slotted end. Of course, the ends of first reversible tool bit 60 could have different geometries or configurations besides those shown. Furthermore, reversible tool bit 60 does not need to be reversible and could be a single ended bit. The second end of the second reversible bit 50 includes an inner cavity (not shown) that is adapted to receive a second reversible tool bit 70 having a first end 72 that is a Philips head and a second end 74 that is a slotted end. Of course, the ends of second reversible tool bit 70 could have different geometries or configurations besides those shown. Furthermore, reversible tool bit 70 does not need to be reversible and could be a single ended bit.

Figure 5:
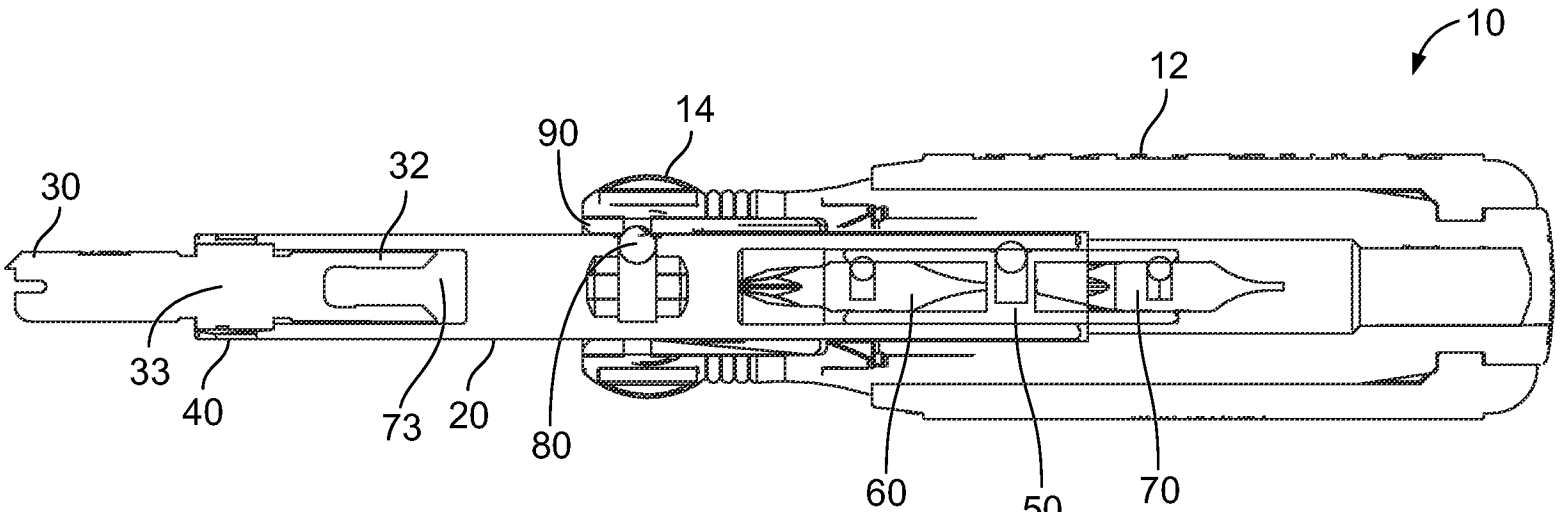
FIG. 5 is a cross-sectional view of the hand tool 10 shown in FIGS. 1 and 2.

FIG. 5 is a cross sectional view of the hand tool 10 shown in FIGS. 1 and 2. The standardized reversible punch down insert 33 is shown with punch down blade 30 extending from tool bit holder 20 and punch down blade 32 positioned within inner cavity 73 of tool bit holder 20. Standardized reversible punch down insert 33 is shown removably secured within tool bit holder 20, such that it can be removed, and reversed 180 degrees so that punch down blade 32 extends from the tool bit holder 20 and punch down blade 30 is positioned within inner cavity 73 of tool bit holder 20. Tool bit holder 20 is itself removably secured within handle 12 by a detent ball 80 positioned within securing member 90 within forward handle portion 14 of handle 12.

In this manner, the tool bit holder 20 may be reversed 180 degrees such that the standardized reversible punch down insert 33 is positioned within handle 12 and the second reversible tool bit 50 may extend from handle 12. In addition, tool bit 60 or tool bit 70 positioned within second reversible tool bit 50 may extend from the handle 12 depending on which way the second reversible tool bit 50 is positioned within the second end of tool bit holder 20. As shown in FIG. 5, the second reversible tool bit 50 may be removably secured within the second end of tool bit holder 20 with a detent ball. Similarly, first tool bit 60 and second tool bit 70 may also be removably secured within the second reversible tool bit 50 with a detent ball. Other known means for securing the second reversible bit 50 within the second end of tool bit holder 20 may also be used, and other known means for securing the first tool bit 60 and the second tool bit 70 within the second reversible tool bit 50 may also be used.

Figure 6:
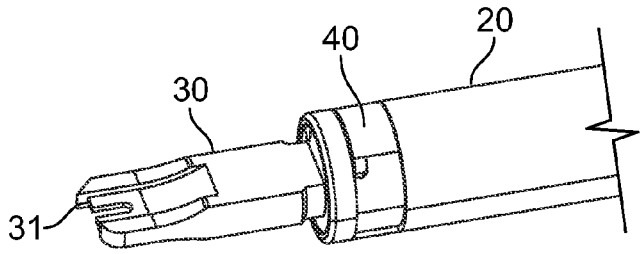
FIG. 6 is a partial perspective view of tool bit holder 20 with standardized reversible punch down insert 33 shown removably secured to the first end of the tool bit holder 20 with circular spring clip 40, that is positioned within hand tool 10 in FIGS. 1 and 2.
Figure 7:
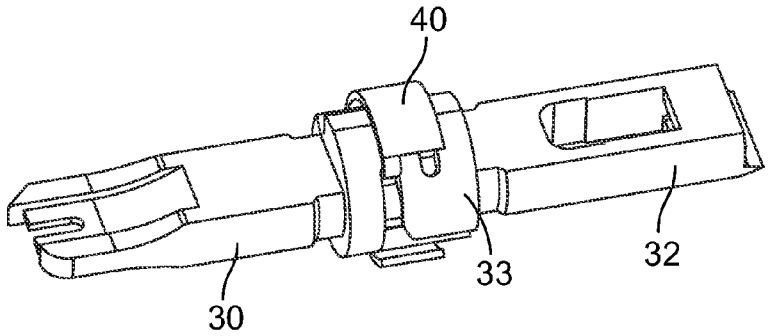
FIG. 7 is a perspective view of the standardized reversible punch down insert 33 and circular spring clip 40 shown in FIG. 6, with the tool bit holder removed.

FIG. 6 is a partial perspective view of tool bit holder 20 with standardized reversible punch down insert 33 shown secured within the first end of the tool bit holder 20 with circular spring clip 40. In this example, the punch down blade 33 with a 110 type end 31 is shown extending from the first end of the tool bit holder 20. FIG. 7 is a perspective view of the standardized reversible punch down insert 33 and circular spring clip 40 shown in FIG. 6, with the tool bit holder removed. In this example, the standardized reversible punch down insert 33 has a punch down blade 32 that is a 66 type end and punch down blade 30 that is a 110 type end that may be removably secured within the first end of the tool bit holder 20 via circular spring clip 40.

Figure 8:
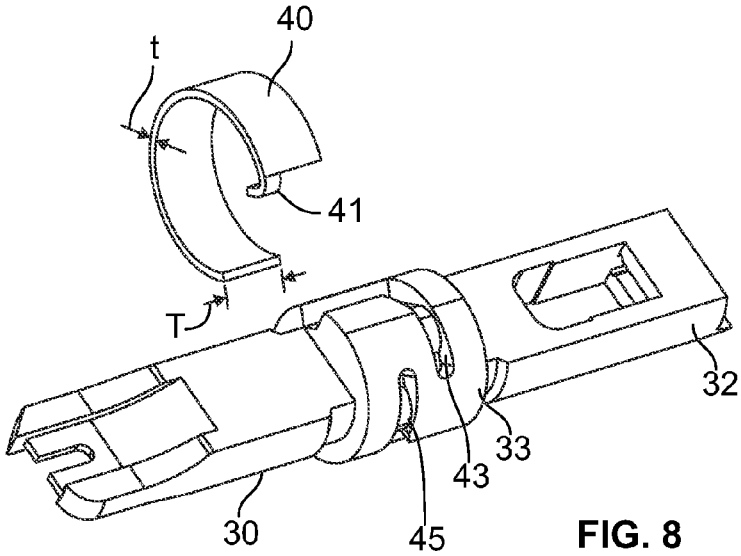
FIG. 8 is an exploded perspective view of the standardized reversible punch down insert 33 and circular spring clip 40 shown in FIGS. 6 and 7.

As shown in FIG. 8, the circular spring clip 40 has an exposed first end and an exposed second end having a protrusion 41 positioned on the second end that extends inwardly. The ends of the circular spring clip may be spread over a groove of reduced outer diameter in the outer surface of the first end of the tool bit holder 20, and the protrusion 41 extends through a hole in the groove and into slot 43 located in standardized reversible punch down insert 33. In this manner, the protrusion 41 and slot 43 provide a bayonet-style locking device, wherein the protrusion 41 extends through a hole in the reduced diameter groove on an outer surface of the first end of the tool bit holder 20 and into slot 43. The standardized reversible punch down insert 33 may be removed from the first end of the tool bit holder 20 by twisting the punch down insert so the protrusion rides through the slot 43 until it exits the slot 43.

When it is desired to have the 66 type end of 32 of the punch down insert 33 extend from the first end of the tool bit holder 20, the punch down insert 33 is removed, rotated 180 degrees, and then re-inserted into the first end of the tool bit holder 20. The protrusion 41 of the circular spring clip 40 is aligned with, and then positioned within, slot 45 to removably secure the punch down insert 33 in place with the 66 type end 32 extending from the first end of tool bit holder 20.

Figure 13:
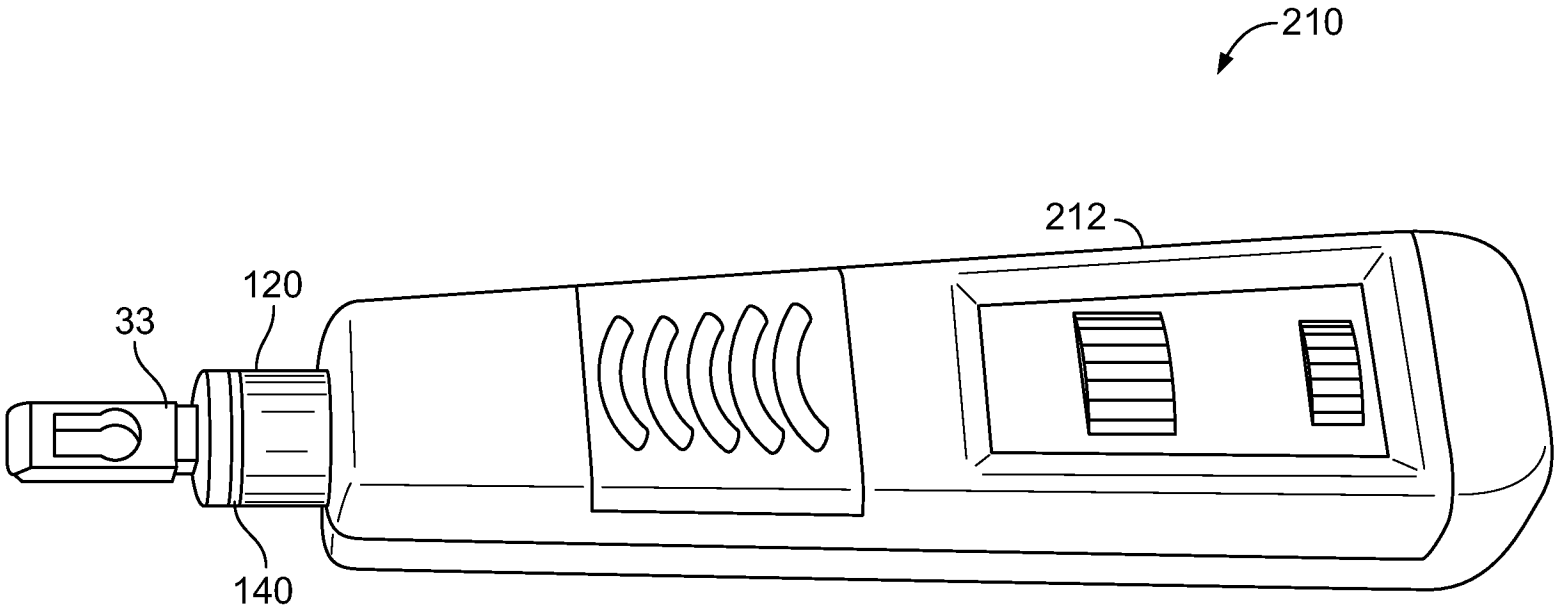
FIG. 13 is an existing punch down tool that is used to house a standardized reversible punch down insert.

FIG. 13 shows a typical, existing punch down tool 210 used to house a standardized reversible punch down insert 33. As can be seen in FIG. 13, the handle 212 of punch down tool 210 is very thick in diameter. As a result, punch down tool 210 would be unwieldy and undesirable to use as a screwdriver if it were adapted to also receive reversible screwdriver bits.

Figure 11A:
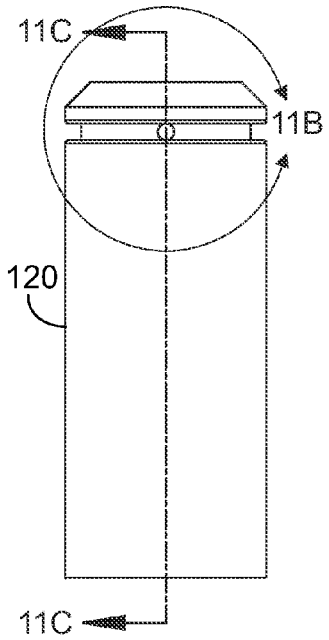
FIG. 11A is a top view of an example of a prior art tool bit holder 120 for holding a standard reversible punch down insert.
Figure 11B:
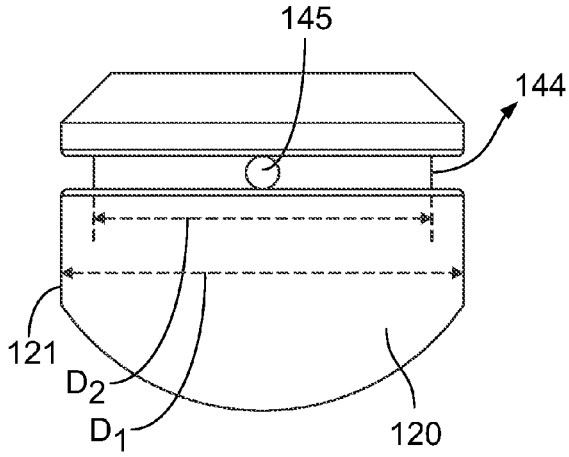
FIG. 11B is a close up view of the circled portion 11B of tool bit holder 120 shown in FIG. 11A.
Figure 11C:
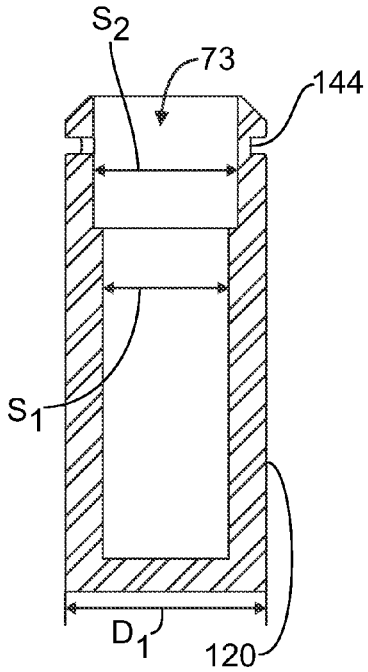
FIG. 11C is a cross sectional view of the punch down tool 120 shown in FIG. 11A taken along line 11C-11C.

FIGS. 11A-11C show a tool bit holder 120 representative of the shaft that is used in typical, existing punch down tools, such as punch down tool 210 shown in FIG. 13, to hold and secure a standardized reversible punch down insert 33 in place. The inner cavity 73 of tool bit holder 120 has a first inner diameter $S_1$ positioned inwardly from a second inner diameter $S_2$. The diameter $S_1$, to accommodate a standardized reversible punch down tool, is ⅜ths of an inch, and diameter $S_2$ to accommodate the central portion of reversible punch down insert 33 having slots 43 and 45 positioned thereon, requires a larger diameter of 0.435 inches. In order to house and accommodate the size of a standardized reversible punch tool insert 33, as shown in FIGS. 11B and 11C, the outer diameter $D_1$ of the tool bit holder 120 is relatively large, and may be measured at 0.608 inches.

Figure 12:
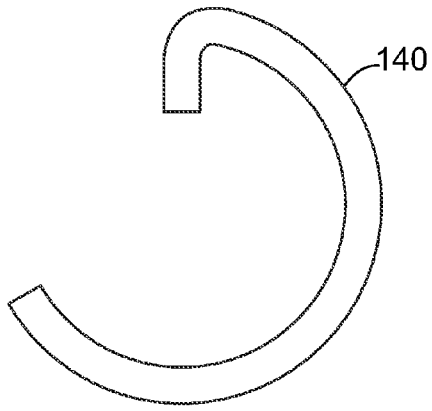
FIG. 12 is a top view of circular spring clip 140 used to secure a standardized reversible punch down insert to tool bit holder 120 shown in FIGS. 11A-11C.

A groove 144 is positioned on the first end of the tool bit holder 120 that is adapted to receive a circular spring clip 140 shown in FIG. 12. The groove 144 has a reduced diameter $D_2$ of 0.508 inches and a longitudinal width of 0.05 inches. Circular spring clip 140 is positioned within groove 144 and a protrusion on an end of circular spring clip 140 extends through hole 145 positioned in groove 144 and into slot 43 or 45 of standardized reversible punch down insert 33 (see FIG. 8) to secure the punch down insert 33 within the first end of tool holder 120. Circular spring clip 140 has a thickness measured between an outer diameter and an inner diameter of 0.05 inches.

A typical screwdriver adapted to receive reversible bits includes an end with a ⅜ths inch hex driver with an outer diameter of 0.530+/−0.002 inches. As noted above, the typical tool bit holder 120 adapted to receive the standardized reversible punch down insert 33 has an outer diameter $D_1$ of 0.608 inches. Therefore, if one wanted to provide a reversible tool bit holder that included a ⅜ths inch hex driver on one end (having an outer diameter of 0.530 inches) and the other end adapted to receive the standardized reversible punch down insert 33, the typical tool bit holder 120 with an outer diameter $D_1$ of 0.608 inches would result in opposite ends of the reversible bit having different diameters. This result would not be optimal because it would potentially require spacers for the end with ⅜ths inch hex driver and could result in a hand tool with a handle that is thicker in diameter than desired.

As noted above, the circular spring clip 140 has a thickness of 0.05 inches and a longitudinal width of 0.05 inches. One could try to reduce the outer diameter $D_1$ of the tool bit holder 120 from 0.608 inches to 0.530 inches so that the outer diameter of the tool bit holder was the same diameter as the outer diameter of a typical screwdriver with a ⅜ths hex driver, and try to use a circular spring clip with a thickness of 0.05 inches. However, the resulting tool bit holder could not be used because if a tool bit holder with an outer diameter of 0.530 inches included a groove adapted for a circular spring clip with a thickness of 0.05 inches, the resulting outer diameter of the groove would be 0.430 inches, which is less than the inner diameter $S_2$ of 0.435 inches required to accommodate a standardized reversible punch down insert 33 (see FIG. 11C). Therefore, it is not possible to use the existing spring clip having a thickness of 0.05 inches on a tool bit holder having an outer diameter of 0.530 inches, because the groove would be too deep and cut through to the interior of the inner cavity 73 of the first end of the tool bit holder 120.

Thus, trying to provide a standardized reversible punch down insert 33 on the opposite end of a typical reversible bit holder with a standard ⅜ hex driver presents a number of difficulties. First, because the standardized reversible punch down insert 33 is significantly thicker than the reversible bits present in typical screwdriver multi-tools, the inner diameter of the tool bit holder must be increased, meaning that more material would need to be removed from the interior of the shaft of the typical screwdriver multi-bit tool holder to house the punch down insert 33. Second, because the outer diameter of the tool bit holder must provide a groove for the circular spring clip, additional material has to be removed from the exterior of the multi-bit tool holder to form the groove. Third, the tool bit assembly must also fit into the collet of the multi-tool handle, which requires that the outer diameter of the typical tool bit holder used for a standardized reversible punch down insert must be reduced, resulting in still more material being removed from the outer diameter of the tool bit holder. Finally, the circular spring clip must remain strong enough to hold the punch down insert 33 in the tool bit holder without breaking or bending too much. The conflict between these four parameters makes providing a tool bit holder having a typical ⅜ hex driver on one end and a standardized reversible punch down tool on the other end that fits within a typical multi-bit screwdriver handle a great challenge.

The present embodiments provide a reversible tool bit holder 20 that has one end that is a ⅜ths standard hex driver with an outer diameter of 0.530+/−0.002 inches that is adapted to receive reversible screwdriver bits and fit within the handle of a typical multi-bit screwdriver. The tool bit holder 20 has another end that is adapted to receive a standardized reversible punch down insert 33, where the end also has an outer diameter of 0.530 inches.

Figure 9:
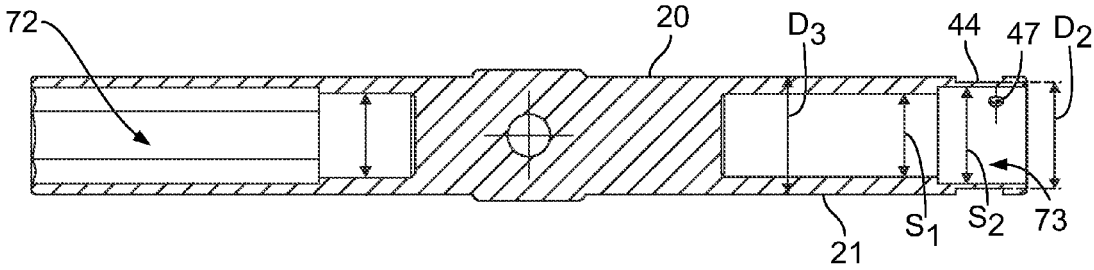
FIG. 9 is a cross sectional view of the tool bit holder 20 shown in FIGS. 1-6.

FIG. 9 is a cross sectional view of the tool bit holder 20 shown in FIGS. 1-6. The first end of the tool bit holder 20 has an inner cavity 73 adapted to receive the standardized reversible punch down insert 33. In particular, the inner cavity 73 has first inner diameter $S_1$ positioned inwardly from a second inner diameter $S_2$. The diameter $S_1$, to accommodate a standardized reversible punch down tool, is ⅜ths of an inch, and diameter $S_2$ to accommodate the central portion of reversible punch down insert 33 having slots 43 and 45 positioned thereon, has a larger diameter of 0.435 inches. As can be seen, the diameters $S_1$ and $S_2$ in FIGS. 9 and 11C are the same. Inner diameter $S_1$ is ⅜ths inches and inner diameter $S_2$ is 0.435 inches. Both tool bit holder 20 in FIG. 9 and tool holder 120 in FIG. 11C are adapted to receive a standardized reversible punch down insert 33.

The outer diameter of the first end of tool bit holder 20 is the same as the diameter of the second end of the tool bit holder 20 so that it may easily be reversed within handle 12 of hand tool 10. In particular, outer diameter $D_3$ of tool bit holder 20 is 0.530+/−0.002 inches. A groove 44 is positioned on the outer surface of the first end of the tool bit holder having a reduced diameter $D_4$ of 0.480 inches. Groove 44 is adapted to receive circular spring clip 40 shown in FIGS. 10A and 10B. Circular spring clip 40 has a protrusion 41 that extends inwardly. When circular spring clip 40 is positioned over groove 44, protrusion 41 extends through hole 47 in groove 44 and into slot 43 or 45 on standardized reversible punch down insert 33 as shown in FIGS. 6-8.

Figure 10A:
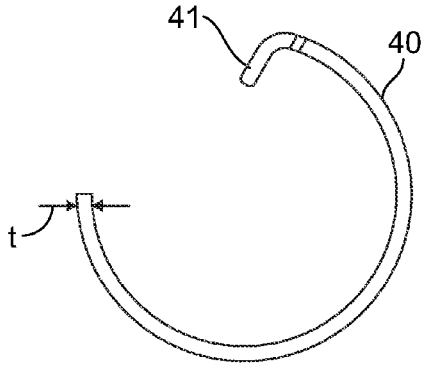
FIG. 10A is a top view of the circular spring clip 40 shown in FIGS. 1-8.
Figure 10B:
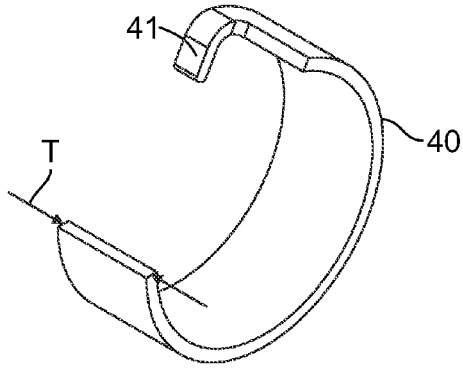
FIG. 10B is a perspective view of the circular spring clip 40 shown in FIG. 10A.

FIG. 10A is a top view of the circular spring clip 40 shown in FIGS. 1-8 and FIG. 10B is a perspective view of the circular spring clip 40 shown in FIG. 10A. Circular spring clip 40 has a thickness "t" measured between an outer diameter and an inner diameter of circular spring clip 40 of 0.024+/−0.002 inches. The outer diameter of circular spring clip is such that it does not extend beyond the outer surface of the first end of the tool bit holder 20 which has a diameter of 0.530+/−0.002 inches. Circular spring clip 40 has width or thickness "T" in a longitudinal direction which may be around 0.2 inches, and in a preferred embodiment is 0.197 inches. In addition, in a preferred embodiment the circular spring clip 40 is comprised of SK5 spring steel. As will be appreciated, the strength of the circular spring steel with its reduced thickness "t" of around 0.024 inches is not as strong as it would be if it had a thickness of 0.05 inches like circular spring clip 140 shown in FIG. 12. As result, the longitudinal width "T" has been substantially increased. A ratio of 7:1 or more between longitudinal width "T" and thickness "t" has been found to provide sufficient strength for the circular spring clip 40 to retain the standardized reversible punch insert 33 in place on the first end of tool bit holder 20.

In addition, it has been determined that the hardness of circular spring clip 40 should be between 35 and 40 HRC inclusive. It has been found that if circular spring clip 40 is too soft, less than 35 HRC, it may bend too much and the protrusion 41 of circular spring clip 40 may pop loose from the slots 43 or 45 in the punch down insert 33. It has also been found that if circular spring clip 40 is too hard, greater than 40 HRC, it may break. Accordingly, in a preferred embodiment the hardness of the circular spring clip 40 is between 35 and 40 HRC inclusive.

The present embodiments provide a combination punch down tool/screwdriver having a reversible tool bit holder with a ⅜ hex driver on one thereof, which is commonly used with reversible screwdriver bits, and also includes the other end that is adapted to receive a standardized reversible punch down insert, where the diameter of the other end of the reversible tool bit holder is the same size as the first end so that no spacers or adapters are required when the tool holder is reversed and inserted in to the handle of the tool. Such a reversible tool bit holder has never been achieved prior to the present embodiments.

The present embodiments provide a combined punch down tool/screwdriver which advantageously provides technicians a single tool that can perform a multitude of functions. In particular, the hand tool 10 includes a tool bit holder 20 having one end having a typical ⅜ths hex driver that may accommodate reversible screwdriver bits, and fit within the handle of a typical screwdriver. The hand tool 10 also includes a tool bit holder 20 that includes a second end having the same diameter as the first end that is adapted to receive a standardized reversible punch down insert 33. The resulting tool provides a combined screwdriver/punch down tool. Consequently, the number of tools that a data communication technician is required to carry may be reduced.

Example embodiments of the present embodiments have been described above. Those skilled in the art will understand that changes and modifications may be made to the described embodiments without departing from the true scope and spirit of the present invention, which is defined by the claims.

I claim:

1. A hand tool comprising:

a handle with an inner cavity;

a tool bit holder removably secured within the inner cavity of the handle the tool bit holder having a first end adapted for receiving a first reversible tool bit and a second end adapted for receiving a second reversible tool bit;

wherein a first reversible tool bit may be removably secured within an inner cavity positioned within the first end of the tool bit holder using a circular spring clip extending around an outer surface of the first end of the tool bit holder;

wherein a second reversible tool bit may be removably secured within an inner cavity positioned within the second end of the tool bit holder;

wherein the first reversible tool bit has a first punch down blade on a first end thereof and a second punch down blade on a second end thereof; and wherein the outer diameter of the first end of the tool bit holder is 0.532 inches or less.

2. The hand tool of claim 1, wherein the first end of the tool bit holder has a reduced outer diameter groove on an outer surface thereof to accommodate the circular spring clip.

3. The hand tool of claim 2, wherein the reduced diameter groove of the first end of the tool bit holder has a diameter of 0.478 to 0.480 inches.

4. The hand tool of claim 2, wherein the reduced diameter groove of the first end of the tool bit holder extends longitudinally 0.213 inches or more.

5. The hand tool of claim 4, wherein the reduced diameter groove of the first end of the tool bit holder has a diameter of 0.478 to 0.480 inches.

6. The hand tool of claim 2, wherein the circular spring clip is has an inner diameter adapted to wrap around the reduced diameter groove of the first end of the tool bit holder when the reduced diameter groove is 0.478 to 0.480 inches.

7. The hand tool of claim 2, wherein the circular spring clip has an outer diameter that does not extend beyond 0.532 inches when it is wrapped around the reduced diameter groove of the first end of the tool bit holder.

8. The hand tool of claim 7, wherein the circular spring clip has a hardness of 35-40 HRC.

9. The hand tool of claim 8, wherein the circular spring clip is comprised of SK5 spring steel.

10. The hand tool of claim 1, wherein the circular spring clip has a thickness in a longitudinal direction of 0.197 inches or more.

11. The hand tool of claim 10, wherein the circular spring clip has a thickness measured between an inner diameter and an outer diameter of between 0.022 and 0.026 inches inclusive.

12. The hand tool of claim 11, wherein the circular spring clip has a hardness of 35-40 HRC.

13. The hand tool of claim 12, wherein the circular spring clip is comprised of SK5 spring steel.

14. The hand tool of claim 1, wherein the circular spring clip has a thickness measured between an inner diameter and an outer diameter of between 0.022 and 0.026 inches inclusive.

15. The hand tool of claim 1, wherein the second end of the tool bit holder has an outer diameter of 0.532 inches or less.

16. The hand tool of claim 1, wherein the second end of the tool bit holder comprises a ⅜ inch hex driver.

17. The hand tool of claim 16, wherein the second reversible bit comprises a Philips head on a first end thereof and a slotted head on a second end thereof.

18. The hand tool of claim 1, wherein a first punch down blade has a type 110 end and the second punch down blade has a type 66 end.

19. The hand tool of claim 1, wherein the second reversible tool bit holder further includes an inner cavity on a first end thereof adapted to receive a first tool bit and an inner cavity on a second end thereof adapted to receive a second tool bit.

20. The hand tool of claim 19, wherein the first tool bit is a reversible tool bit with a bit on a first end thereof and a second end thereof and the second tool bit is a reversible tool bit with a bit on a first end thereof and a second end thereof.

21. The hand tool of claim 20, wherein the circular spring clip has a hardness of 35-40 HRC.

22. The hand tool of claim 19, wherein the circular spring clip has an outer diameter that does not extend beyond 0.532 inches when it is wrapped around a reduced diameter groove of the first end of the tool bit holder.

23. A hand tool comprising:

a handle with an inner cavity;

a tool bit holder removably secured within the inner cavity of the handle the tool bit holder having a first end adapted for receiving a first reversible tool bit and a second end adapted for receiving a second reversible tool bit;

wherein a first reversible tool bit may be removably secured within an inner cavity positioned within the first end of the tool bit holder using a circular spring clip extending around an outer surface of the first end of the tool bit holder;

wherein a second reversible tool bit may be removably secured within an inner cavity positioned within the second end of the tool bit holder;

wherein the first reversible tool bit has a first punch down blade on a first end thereof and a second punch down blade on a second end thereof; and wherein the circular spring clip has a thickness in a longitudinal direction that is more than 7 times a thickness of the circular spring clip measured between an inner diameter of the circular spring clip and an outer diameter of the circular spring clip.

24. The hand tool of claim 23, wherein the thickness in the longitudinal direction is 0.197 inches or more.

25. The hand tool of claim 23, wherein the circular spring clip has a thickness measured between the inner diameter and the outer diameter of between 0.022 and 0.026 inches.

26. The hand tool of claim 23, wherein the circular spring clip is has an inner diameter adapted to wrap around a reduced diameter groove of the first end of the tool bit holder when the reduced diameter groove is 0.478 to 0.480 inches.

27. The hand tool of claim 26, wherein the circular spring clip has an outer diameter that does not extend beyond 0.532 inches when it is wrapped around the reduced diameter groove of the first end of the tool bit holder.

28. The hand tool of claim 23, wherein the circular spring clip has a hardness of 35-40 HRC.

29. The hand tool of claim 28, wherein the circular spring clip is comprised of SK5 spring steel.

30. A hand tool comprising:

a handle with an inner cavity;

a tool bit holder removably secured within the inner cavity of the handle the tool bit holder having a first end adapted for receiving a first reversible tool bit and a second end adapted for receiving a second reversible tool bit;

wherein a first reversible tool bit may be removably secured within an inner cavity positioned within the first end of the tool bit holder using a circular spring clip extending around the outer surface of the first end of the tool bit holder;

wherein a second reversible tool bit may be removably secured within an inner cavity positioned within the second end of the tool bit holder;

wherein the first reversible tool bit has a first punch down blade on a first end thereof and a second punch down blade on a second end thereof;

wherein the circular spring clip has a thickness in a longitudinal direction of 0.197 inches or more and a thickness of the circular spring clip measured between an inner diameter of the circular spring clip and an outer diameter of the circular spring clip is between 0.022 and 0.026 inches; and wherein the outer diameter of the circular spring clip does not extend beyond the outer surface of the first end of the tool bit holder.

31. The hand tool of claim 30, wherein the circular spring clip has an outer diameter that does not extend beyond 0.532 inches when it is wrapped around a reduced diameter groove of the first end of the tool bit holder.

32. The hand tool of claim 31, wherein the circular spring clip has a hardness of 35-40 HRC.

33. A hand tool comprising:

a handle with an inner cavity;

a reversible tool bit holder removably secured within the inner cavity of the handle the tool bit holder having a first end adapted for receiving a first reversible tool bit and a second end adapted for receiving a second reversible tool bit;

wherein a first reversible tool bit may be removably secured within an inner cavity positioned within the first end of the tool bit holder using a circular spring clip extending around an outer surface of the first end of the tool bit holder;

wherein a second reversible tool bit may be removably secured within an inner cavity positioned within the second end of the tool bit holder;

wherein the first reversible tool bit has a first punch down blade on a first end thereof and a second punch down blade on a second end thereof;

wherein the second end of the tool bit holder is a ⅜ hex driver and the second end of the tool bit holder has an outer diameter; and wherein the first end of the tool bit holder has an outer diameter that is the same size as the outer diameter of the second end of the tool bit holder.

* * * * *